United States Patent [19]

Olson et al.

[11] 3,942,713

[45] Mar. 9, 1976

[54] PRESSURE SENSITIVE ADHESIVE CLOSURE FOR BAGS INCORPORATING AN ADHESIVE CUFF-LOCK DESIGN

[75] Inventors: Robert H. Olson, Pittsford; William J. Clayton, Fairport, both of N.Y.

[73] Assignee: Mobil Oil Corporation, New York, N.Y.

[22] Filed: Feb. 25, 1974

[21] Appl. No.: 445,180

[52] U.S. Cl. ..... 229/62; 150/7; 206/260

[51] Int. Cl.[2] ..... B65D 33/16

[58] Field of Search ..... 229/62, 66, 80, 54 R; 150/7; 206/260, 438, 439, 813

[56] References Cited

UNITED STATES PATENTS

| | | | |
|---|---|---|---|
| 2,384,223 | 9/1945 | Wilbur | 229/80 X |
| 2,755,576 | 7/1956 | Golden | 206/813 X |
| 3,338,019 | 8/1967 | Trewella et al. | 229/62 |
| 3,419,136 | 12/1968 | Pratt | 229/66 X |
| 3,478,868 | 11/1969 | Nerenberg et al. | 206/439 |
| 3,510,052 | 5/1970 | Ruda | 150/7 X |
| 3,595,468 | 7/1971 | Repko | 229/62 |
| 3,670,947 | 6/1972 | Tangredi et al. | 229/62 X |

*Primary Examiner*—William Price
*Assistant Examiner*—Stephen P. Garbe
*Attorney, Agent, or Firm*—Charles A. Huggett; James D. Tierney

[57] ABSTRACT

A thermoplastic bag comprising a front wall and a rear wall. The upper edge of said rear wall is turned inwardly and the resultant downwardly facing pouch is sealed along its edges to the upper edges of the rear bag walls. The upper portion of the front bag wall has an adhesive stripe extending across the width thereof. The adhesive stripe is protected from direct contact with the pouch on the opposite wall, until it is desired to close and seal the bag, by means of a strip of release paper covering the adhesive or, alternatively, by folding a portion of the front bag wall back upon itself to cover the adhesive stripe.

3 Claims, 5 Drawing Figures

PRESSURE SENSITIVE ADHESIVE CLOSURE FOR BAGS INCORPORATING AN ADHESIVE CUFF-LOCK DESIGN

BACKGROUND OF THE INVENTION

1. Field of the Invention

The present invention relates to thermoplastic bags and in particular specially-designed bags having an adhesive closure arrangement. The adhesive is protectively covered until it is desired to close and seal the bag.

The bag comprises a specially-designed pouch formed interiorly of the bag adjacent the open mouth thereof. The cuff is designed to contain one end of an article which is packaged in the bag. The pouch forms a primary, built-in mechanical closure for containing the bag contents. Additionally, a secondary adhesive stripe closure located intermediate the outer pouch wall and the adjacent bag wall provides a tight, integral closure protecting the contents of the bag against intrusion of dust and foreign materials and additionally preserving the freshness of the bag contents. An added advantage of such a bag closure is that since the primary strength of the closure is derived from the interiorly bag pouch, the need for strength in the adhesive seal is not as critical as when only a pressure sensitive adhesive is employed to close and contain the bag contents. This allows for the adhesive which is employed on the bags to be much less aggressive or tacky, thereby facilitating ease of handling and closure manipulation of individual bags.

2. Brief Description of Prior Art

In the past, numerous closure arrangements have been proposed and employed as closure devices for securing plastic bags in a closed condition. Such devices include rubber bands or so-called twist-ties, paper or plastic coated lengths of wire, which are fastened around the gathered and twisted neck of a plastic bag to secure it in closed condition. An obvious disadvantage of such closure devices is that they do not form an integral part of the bag structure and hence, may not in many instances be readily accessible when it is desired to effect closure of the bag. Another closure arrangement for plastic bags which has been employed in the past, without significant commercial success, is the employment of an exposed and unprotected adhesive stripe adjacent the open mouth of such bag structures. Such an arrangement presented many drawbacks. When such bags were packaged within a dispensing carton either in continuous roll form or individually adjacent to one another, the bags had a tendency to stick to one another as well as to exterior objects following dispensing of individual bags from the container, thus making it difficult to use the bags. Also, the adhesives necessarily were relatively non-aggressive in an attempt to alleviate such problems thereby making the closures insecure.

SUMMARY OF THE INVENTION

The invention is directed to thermoplastic bags having front and rear walls which are integrally joined along their bottom edges. The longitudinal edges of the bag walls are heat sealed together along the major portion of their edges. The upper portion of the bag rear wall is folded downwardly and sealed along its opposite edges to the upper edges of the bag rear wall thereby forming a downwardly facing pouch. The upper portion of the front bag wall forms a locking flap which has a pressure sensitive stripe extending across the width of the flap. The pressure sensitive stripe is adapted to be adhesively secured to the downwardly facing pouch. The adhesive stripe is protected from direct contact with the adjacent pouch on the rear wall until it is desired to close and seal the bag. The adhesive stripe protection may take the form of a disposable release paper covering the stripe or, alternatively, the flap may be folded back upon itself in a manner that covers the adhesive stripe. When a product, such as a sandwich, is inserted into the open mouth of the bag and the closure flap adhesively secured to the outer surface of the pouch the bag securely encases the sandwich and when the bag is inverted, the bag contents enter the pouch and remain securely encased.

DESCRIPTION OF SPECIFIC EMBODIMENTS

Figure 2:
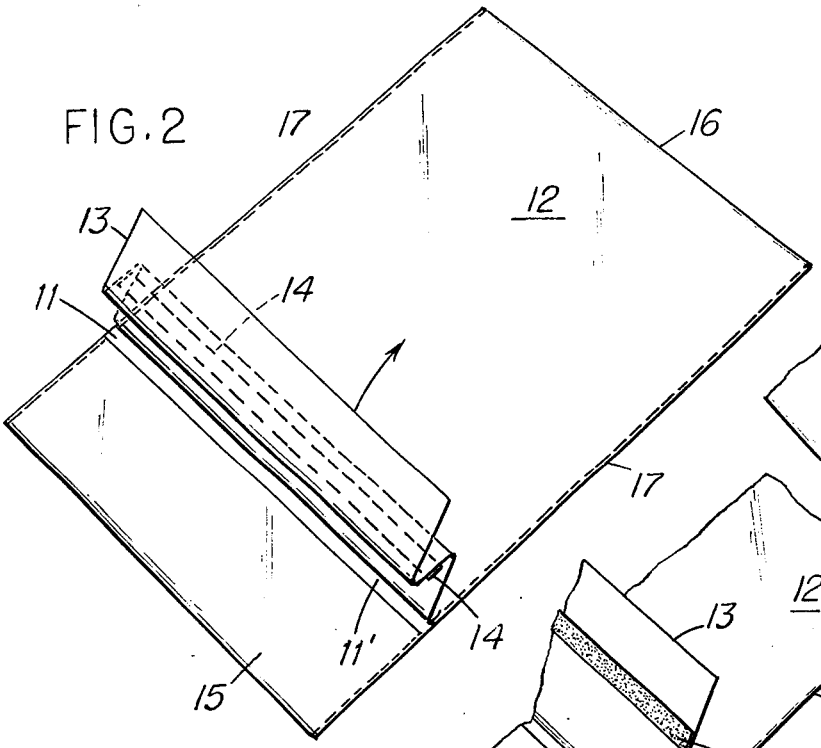
FIG. 2 is a persepective view of the bag shown in FIG. 1 during the initial closing manipulation.
Figure 1:
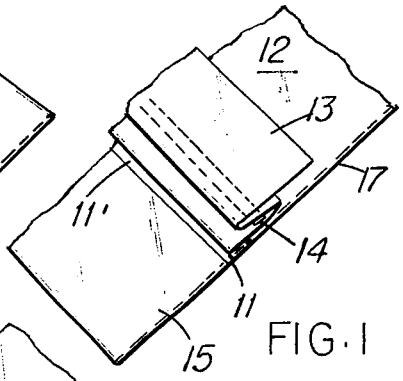
FIG. 1 is a perspective, fragmentary view of an embodiment of the bag structure of the present invention in an open position.
Figure 3:
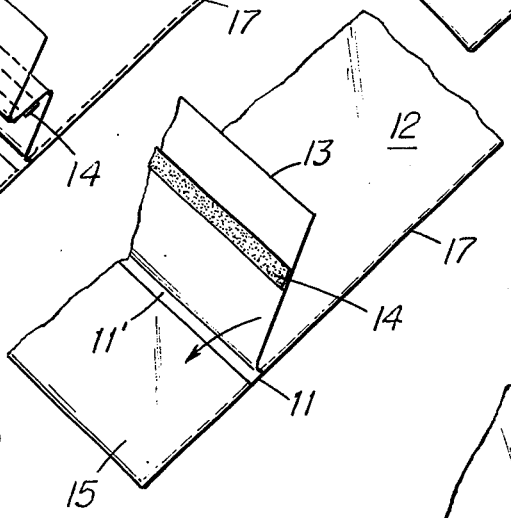
FIG. 3 is a fragmentary, perspective view of the bag shown in FIG. 2 as the closing manipulation continues.
Figure 4:
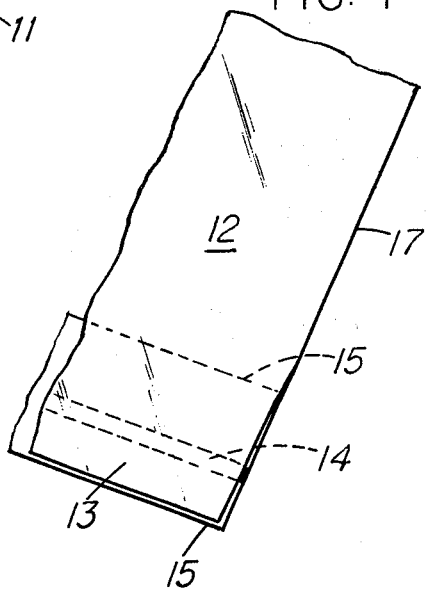
FIG. 4 is a fragmentary perspective view of the bag structures shown in FIGS. 1 through 3 in a closed and sealed condition.
Figure 5:
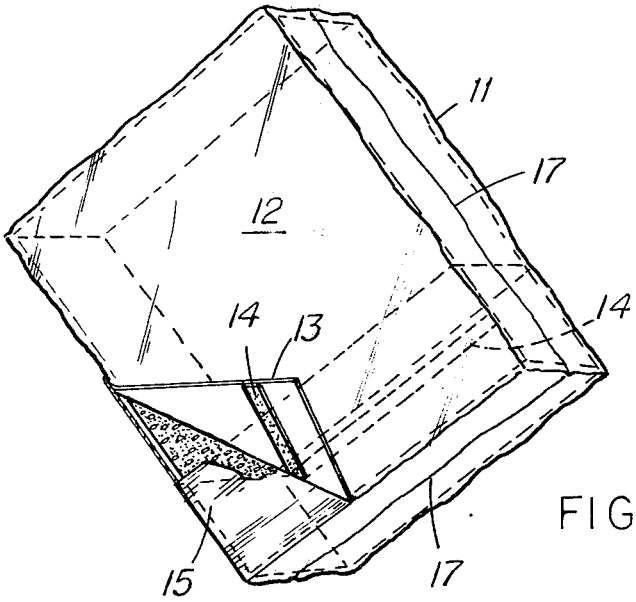
FIG. 5 is a perspective view of the bag structure of the present invention in the closed and sealed condition and containing a product, e.g. a sandwich.

As shown in FIGS. 1 and 2 the bag structures of the present invention comprise a front wall 12 and a rear wall 11, the walls being joined together by fold line 16 at the bag bottom and heat seals 17 secure the major portion of the longitudinal edges of the bag. The upper portion of rear wall 11 is folded downwardly to form a downwardly facing pouch the edges of which are secured, as by heat sealing to the upper longitudinal edges of rear wall 11. Also as shown in FIGS. 1 and 2 the upper portion of front wall 12 forms a closure flap 13. Flap 13 has a stripe of pressure sensitive adhesive 14 extending across its width. Suitable adhesive materials which may be employed include acrylic resins, natural and synthetic based rubbers, and polyvinyl ether based pressure sensitive adhesives. Adhesive stripe 14 is protected from premature adherence to the bag structure proper or to extraneous objects by folding a portion of closure flap 13 back upon itself in such a manner that a "Z-fold" is produced, as shown in FIG. 1, whereby a portion of closure flap 13 now protectively covers adhesive stripe 14. As shown in FIGS. 2 and 3, when it is desired to close and seal the bag, the upper edge of locking flap 13 is pulled upwardly unfolding the "Z-fold" until the adhesive stripe is completely exposed, see FIG. 3. The locking flap 13 is then folded upwardly until adhesive stripe 14 is brought into pressure engagement with cuff 15, as shown in FIG. 4, thereby sealing the mouth 11′ of the bag. FIG. 5 illustrates a commodity, such as a sandwich which has been protectively enclosed by the bag structure of the present invention.

Although not illustrated in the accompanying drawings, a strip of coated release paper may be used to protectively cover adhesive stripe 14 until ready for use rather than employing the "Z-fold" configuration as illustrated and hereinabove described. Release materials which may be commonly employed generally comprise various types of paper impregnated, typically, with silicone based compounds. Also various plastics, for example, high density polyethylene, have inherent release properties which make them suitable for use as a protective cover in this application. Surface treatment of the bag film by corona discharge, chemical, or other conventional techniques will also make the bag flap 20 more receptive to adhesion by the adhesive.

It will be understood that when an object to be packaged is inserted into the open mouth 11' of the bag and the bag is subsequently sealed, the packaged article is free to slip into the confines of cuff 15 if the bag is turned or inverted as shown in FIG. 5. While cuff 15 provides excellent security for the bag contents, adhesive stripe 14 provides an integral seal which protects the bag contents against the intrusion of foreign materials and additionally maintains the freshness of the bag contents.

Although the present invention has been described with preferred embodiments, it is to be understood that modifications and variations may be resorted to without departing from the spirit and scope of this invention as those skilled in the art will readily understand.

What is claimed is:

1. A thermoplastic bag comprising a front wall and a rear wall, said walls being continuously joined together along their bottom edges, said front and rear walls being heat sealed together along the major portion of their opposite longitudinal edges, the upper portions of said front and rear bag walls initially forming flaps which are not joined together along their opposite longitudinal edges, said rear bag wall upper flap being turned downwardly into overlying relationship with an interior portion of said rear bag wall surface and said rear wall flap being sealed along its opposite longitudinal edges to the upper edges of said rear bag wall, thereby forming a downwardly facing pouch, said upper flap portion of said front bag wall forming a locking flap and being characterized by having a pressure-sensitive adhesive stripe extending across the width of the inner surface of said flap, said locking flap being folded in a Z-fold configuration, a portion of said configuration covering said stripe.

2. A thermoplastic bag structure in accordance with claim 1 whereby said adhesive stripe is protected, until ready for use, by covering said stripe with a length of release paper.

3. A thermoplastic bag in accordance with claim 1 wherein said adhesive is a member selected from the group consisting of acrylic, natural and synthetic rubbers or polyvinyl ether based pressure sensitive adhesives.

* * * * *